US005407085A

United States Patent [19]

Goldring et al.

[11] Patent Number: 5,407,085

[45] Date of Patent: Apr. 18, 1995

[54] DISPLAY RACK

[75] Inventors: Harold B. Goldring, Woodcliff Lake, N.J.; Mark A. Niven, Yonkers; Ronald Namaroff, Hartsdale, both of N.Y.; Leslie G. Davis, North Caldwell, N.J.

[73] Assignee: Colgate-Palmolive Company, New York, N.Y.

[21] Appl. No.: 104,746

[22] Filed: Aug. 11, 1993

[51] Int. Cl.[6] ..... A47F 5/00

[52] U.S. Cl. ..... 211/207; 211/187

[58] Field of Search ..... 211/207, 190, 59.2, 211/59.3, 187, 2; 108/144, 111, 11, 12; 248/157, 165, 188.8

[56] References Cited

U.S. PATENT DOCUMENTS

| | | | |
|---|---|---|---|
| 629,566 | 7/1899 | Hoyt | 221/231 |
| 3,357,669 | 12/1967 | D'Amato | 248/188.9 |
| 4,416,439 | 11/1983 | Dimpfel et al. | 248/188.8 |
| 4,503,781 | 3/1985 | Nilsson | 108/64 |
| 4,550,838 | 11/1985 | Nathan et al. | 211/128 |
| 4,582,001 | 4/1986 | Leikarts | 108/106 |
| 4,981,224 | 1/1991 | Rushing | 211/126 |
| 5,096,186 | 3/1992 | Wilkinson et al. | 272/70 |
| 5,116,044 | 5/1992 | Wilkinson et al. | 482/52 |
| 5,118,096 | 6/1992 | Wilkinson et al. | 482/52 |
| 5,125,646 | 6/1992 | Wilkinson | 482/52 |

*Primary Examiner*—Ramon O. Ramirez
*Assistant Examiner*—Sarah L. Porol
*Attorney, Agent, or Firm*—Robert C. Sullivan; Richard J. Ancel

[57] ABSTRACT

An adjustable tilt construction for a display rack. The rear wall of the rack is provided with one or more T slots, each slot receiving one of the two parallel flanges of a respective leg, the latter generally H shaped in transverse cross section over at least a portion of its length. One flange of each leg is shorter than the other, and is asymmetrically located with respect to it so as to yield two different distances from the ends of the shorter flange to respective ends of the longer flange. This leg configuration permits three different leg heights by inserting each leg into a respective slot in three different ways. In turn, this permits three different tilt angles for the display rack. The leg and slot configuration may also be used on a table to provide height adjustment, the legs and slots operating in the same manner as in the display rack.

10 Claims, 7 Drawing Sheets

FIG. 7
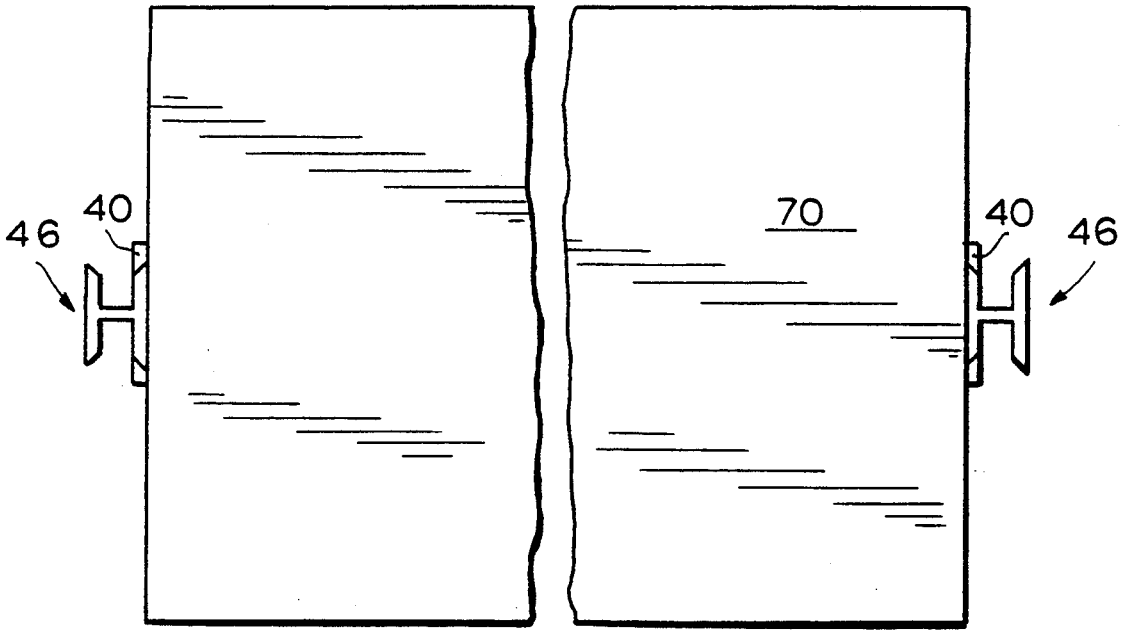
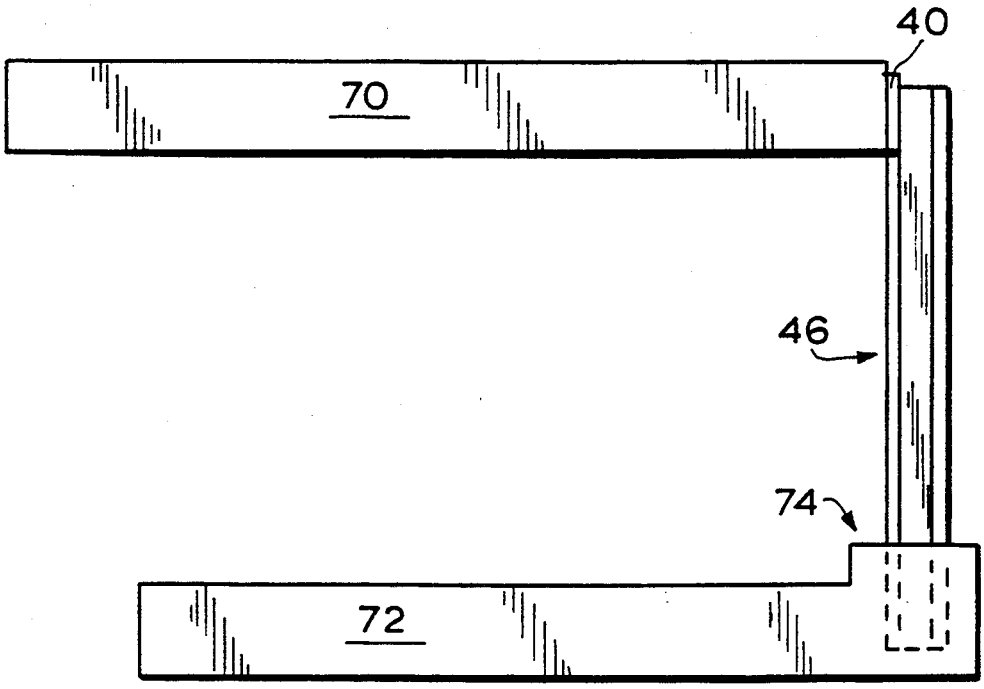
FIG. 8

DISPLAY RACK

BACKGROUND OF THE INVENTION

This invention relates to a tiltable display rack particularly adapted for toothbrushes. Racks for displaying similar items for retail sale are known. For example, U.S. Pat. No. 3,780,873 issued to Silva shows a tilted rack having a plurality of parallel troughs, with a pusher weight behind each row of the displayed articles in each respective trough, the pusher weights functioning by gravity. The use of pusher weights in display racks is also shown in U.S. Pat. No. 1,452,659 issued to Seelman and U.S. Pat. No. 3,393,688 issued to Saverino.

While satisfactory for their respective purposes, these and other known constructions do not yield a display rack whose angle of tilt may be easily varied.

SUMMARY OF THE INVENTION

According to the practice of this invention, a display rack is provided with a rear leg construction which permits the angle of inclination of the display rack to be varied. This is effected by a novel slot and leg configuration, with two such legs in their respective slots usually employed. Each leg is in the general form, in transverse cross section, of an H beam having two parallel flanges joined by a central web, with the plane of the central web being orthogonal to the parallel webs. One of the two flanges of the H beam is shorter than the other. The respective ends of the shorter of the two flanges terminate at different distances from neighboring or contiguous respective ends of the flange of greater length. Each slot is located at the rear wall of the rack and receives a respective leg, the rack being typically provided with two H legs. Each slot has an uppermost abutment which defines the slot top or upper end. The slot is open along one side and at its bottom. In use, a leg is slidably inserted into its slot in any one of three different ways. In the first way, either end of the longest flange abuts the slot top. In the second way, one end of the shorter flange abuts the slot top, while in the third way the other end of the shorter flange abuts the slot top. These three ways of leg insertion into a respective slot yield three different degrees of tilt to the display rack. To obtain a different tilt, each leg is slid out of its slot, turned or rotated, and then reinserted.

The novel leg and slot construction of this invention may also be employed to vary the height of a table or other horizontal support surface member by providing at least one slot adjacent the support member periphery and using the novel leg of this invention to effect height adjustment by inserting the leg into the slot in the same three different ways.

BRIEF DESCRIPTION OF THE DRAWINGS

FIG. 7 is a top plan view of a table provided with the leg and slot construction of this invention, so as to produce an adjustable height table.

FIG. 8 is a side elevational view of a table, slot and leg arrangement similar to that of FIG. 7, and wherein only a single supporting leg of adjustable height is employed.

DETAILED DESCRIPTION OF THE INVENTION

Figure 1:
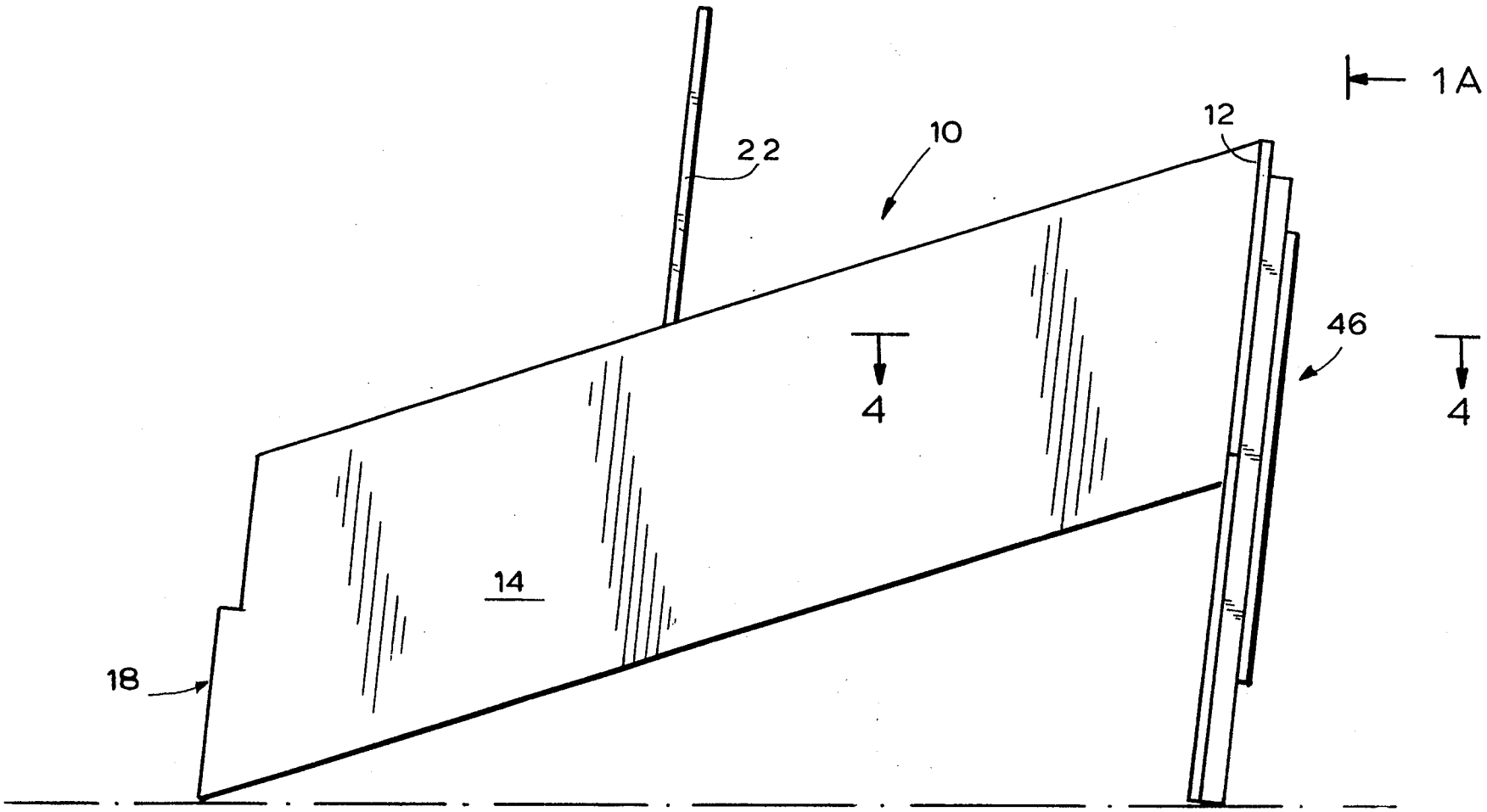
FIG. 1 is a side elevational view illustrating the display rack in its highest tilt position.
Figures 1A, 2A, 3A:
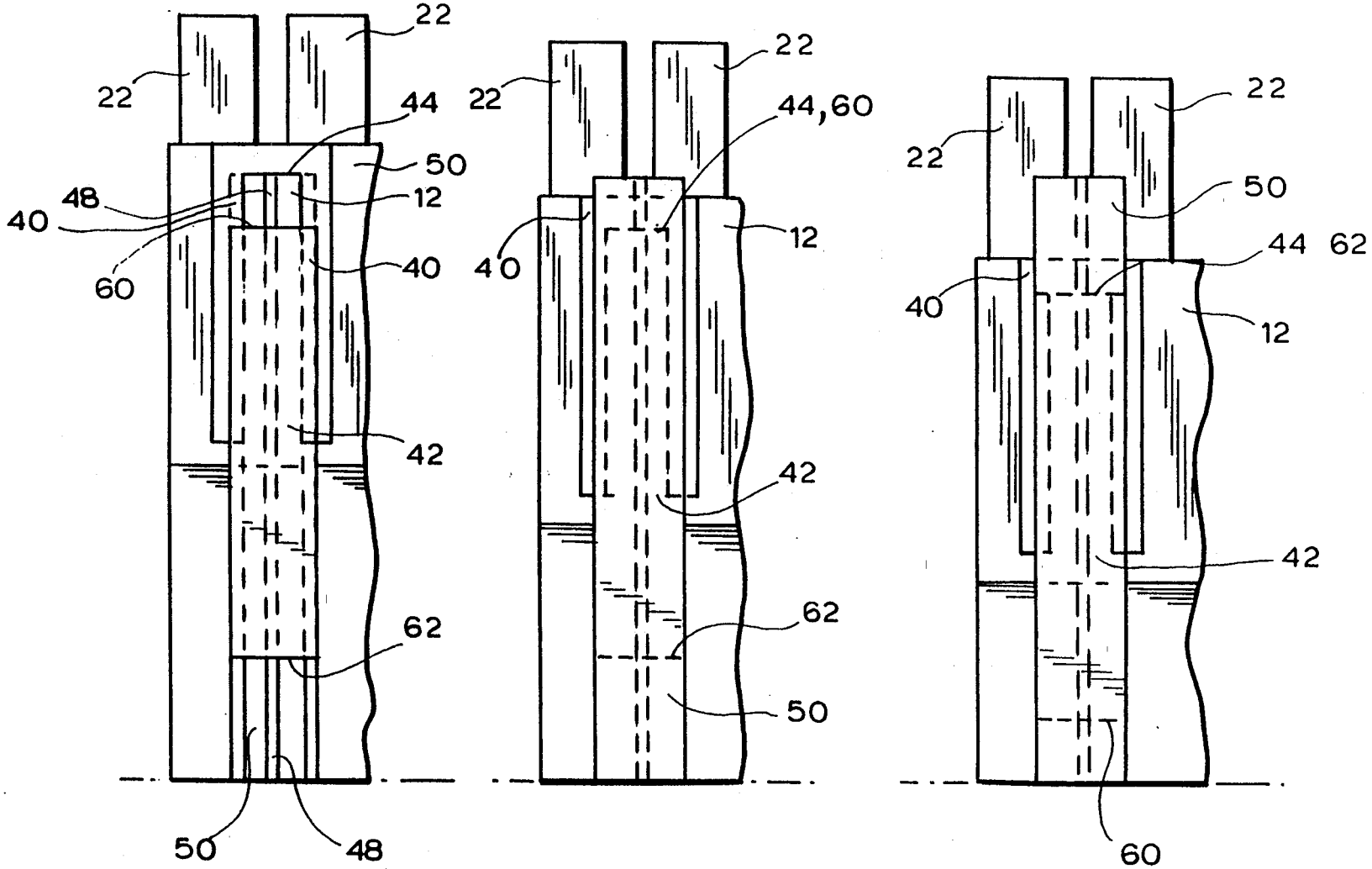
FIG. 1A is a rear view of the rack of FIG. 1 taken along 1A—1A of FIG. 1.
FIG. 2A is a rear view of the rack of FIG. 2 taken along 2A—2A of FIG. 2.
FIG. 3A is a rear view of the rack of FIG. 3 taken along 3A—3A of FIG. 3.
Figure 2:
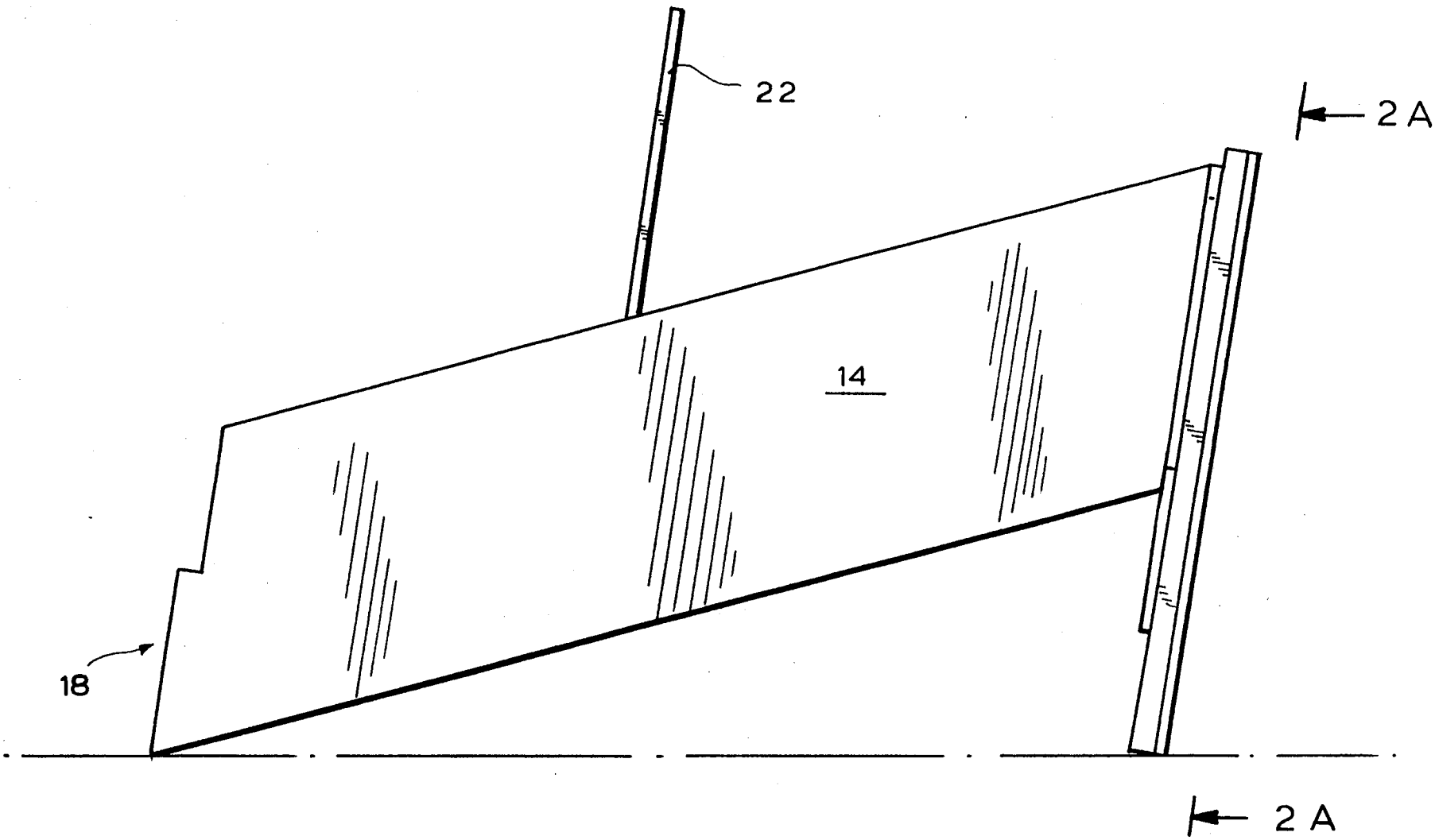
FIG. 2 is a view similar to FIG. 1 is showing the display rack in a second and lower tilt angle.
Figure 3:
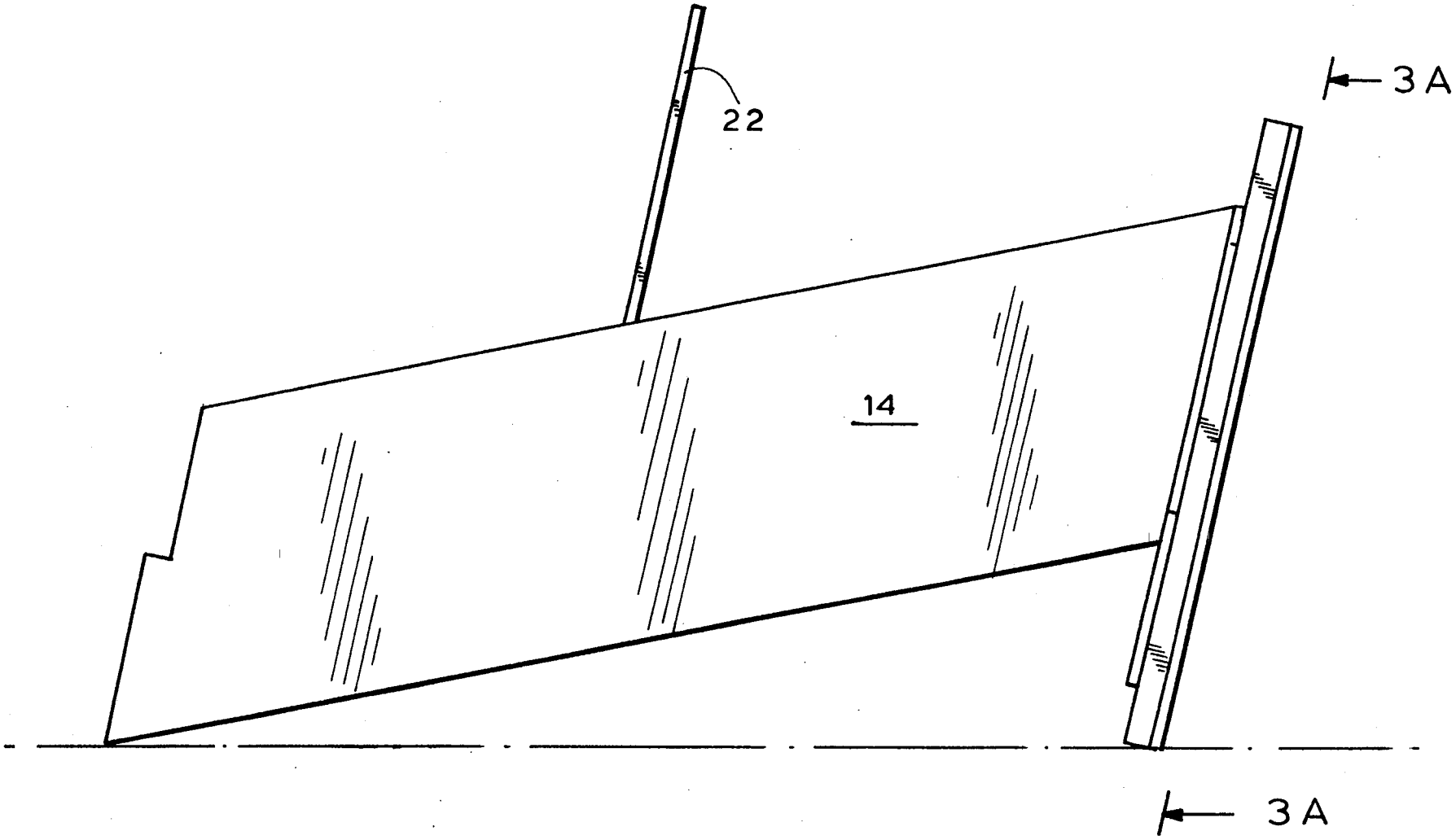
FIG. 3 is a view similar to FIG. 1 and shows the display rack in yet a third and lowest tilt angle.

Referring now to FIGS. 1–3 of the drawings, the display rack of this invention, which is shown here as adapted to display toothbrushes, is generally indicated as 10 and includes a rear wall 12, a pair of opposite and parallel side walls 14, only one of which is seen at FIG. 1, and a front wall 18. One or more legs 46, only one of which is shown, is inserted into a slot in or at rear wall 12, so as to provide a first degree or angle of tilt to tray 10. Upstanding element 22 represents the rear portion of a pusher element, shortly to be described.

FIGS. 2 and 3 are similar to FIG. 1, with FIGS. 1, 2, and 3 differing only in the degree of tilt of the rack tray. These different angles or degrees of tilt are achieved by different manners or ways of inserting legs 46 into their respective slots, as will shortly be described.

Figure 5:
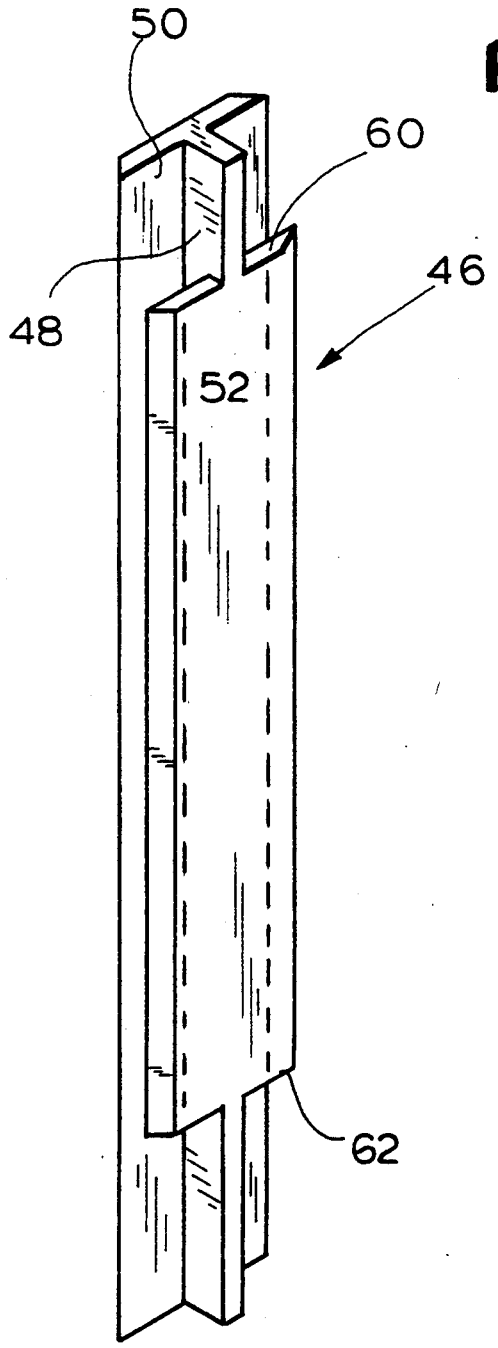
FIG. 5 is a first perspective view of a rear supporting leg according to the practice of this invention, the leg adapted to be inserted into a respective slot at the rear of the display rack.
Figure 6:
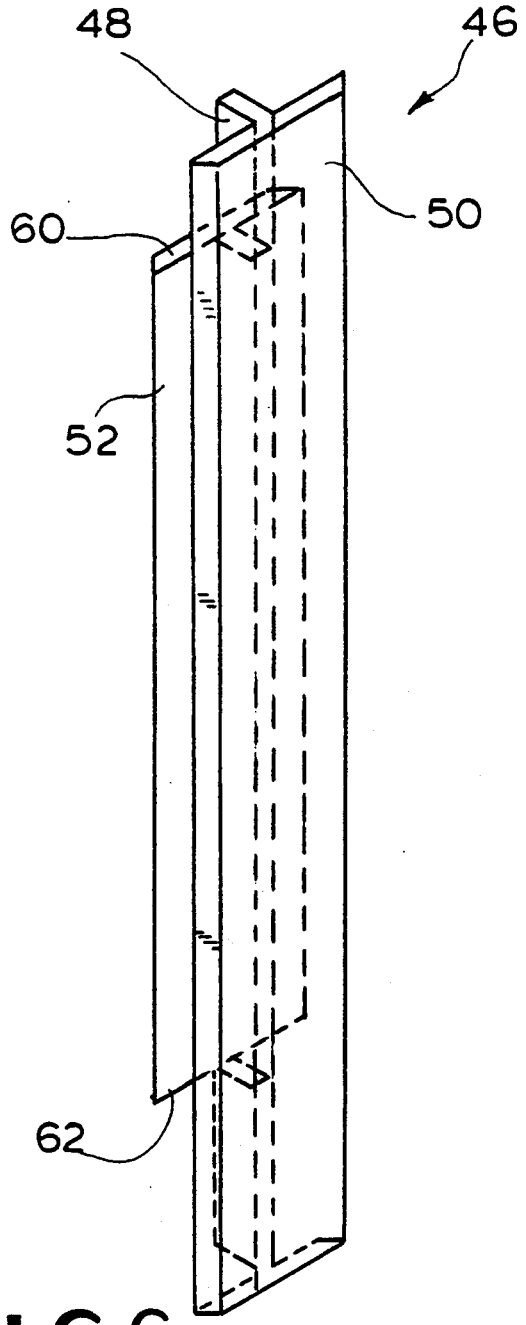
FIG. 6 is a view similar to FIG. 5, but taken at about 180° from the perspective of FIG. 5.

FIGS. 1A, 2A, and 3A illustrate the three ways of inserting a leg 46 shown at FIGS. 5 and 6, into a respective slot.

Figure 4:
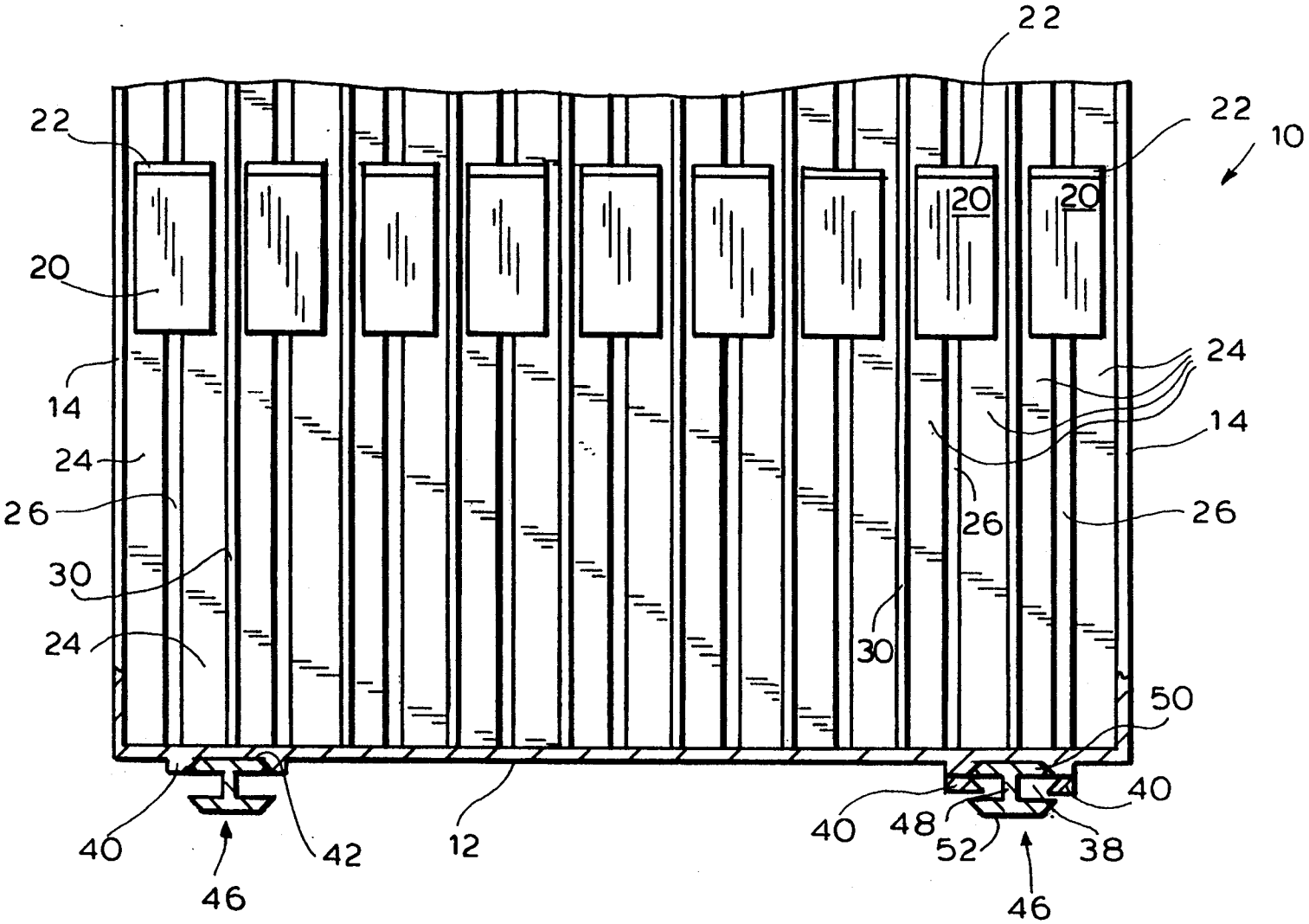
FIG. 4 is a view taken along section 4—4 of FIG. 1.

Referring now to FIG. 4, tray 10 is shown as including a plurality of gravity operated pusher elements each having substantially flat surface portions 20 integrally connected to upstanding and vertically extending back portions 22. Pairs of trough defining strips 24 are separated by a respective gap 26, with each of the strip pairs bordered by walls 30. Flat, lower surface portion 20 are typically provided with T shaped tongues which engage the lower, opposite sides of respective strips 24, with the webs of the tongues extending through respective slots 26. The rack may be formed of a plastic material or of metal.

As known in this art, each back portion 22 is urged by gravity against the rear toothbrush container of a row of toothbrush containers, such that when a purchaser takes the front toothbrush container from a row, at the lowest or front rack portion, the pusher associated with that row forces the remaining toothbrush containers in that row down so as to fill the gap caused by the purchaser-removed lowermost toothbrush container. Clearly, the magnitude of the gravity derived pusher force on the rear of its respective row will vary with the angle of tilt of the rack. In order to vary the pusher force, according to this invention, it is only necessary to vary the manner or way in which each leg is inserted into its respective slot at the rear of the rack. It will be understood that each leg, when plural legs are employed, must be inserted into its respective slot in the same way so that the rear of the rack will be level.

As seen at FIGS. 4 and 1A, 2A, 3A, each rear slot 38 is generally T shaped in transverse section and is defined by spaced overhangs 40, with the lower, open end of each slot denoted as 42 and the upper end having an abutment or closed portion 44. Each slot may be integral with the rear rack wall 12, or may be separately formed and affixed to the rear wall.

Referring now to FIGS. 5 and 6 of the drawings, a typical leg 46 is illustrated. The major length of each leg is in the general form of an H rigid beam. The web portion of each leg is designated as 48, the longest flange designated as 50, while the shortest flange is designated as 52. One end of shorter flange 52 is designated as 60, while the other end of flange 52 is designated as 62. It will be observed that end 60 is closer to a corresponding, neighboring end of longer flange 50 than is end 62 to its closest or neighboring end of longer flange 50. Shorter flange 52 is seen to be asymmetrically located, in a manner parallel to the leg, with respect to the longer flange 50.

Referring now to FIGS. 1A and 4, a leg 46 has been placed into its respective slot 38 through lower slot opening 42, so that the upper end of flange 50 contacts upper abutment 44 of slot 38. This is done for both of the legs shown at FIG. 4 and yields, as shown at FIG. 1, the maximum angle or degree of tilt of rack 10 since the rack rear is elevated by the length of longer flange 50.

Again referring to FIG. 4 and FIG. 2A, leg 46 has been inserted into slot 38 such that upper end 60 of shorter flange 52 is in contact with upper slot abutment 44 of slot 38. FIG. 2 shows that the angle of tilt of the rack is now less than that shown at FIG. 1.

Referring now to FIG. 3A and FIG. 4, leg 46 has been inserted into slot 38 so that end 62 of shorter flange 52 is in contact with upper slot abutment 44. Considering FIG. 3, the reader will readily see that this yields the lesser tilt of the three tilt angles shown at FIGS. 1, 2, and 3.

In each of these three ways of leg insertion, FIG. 4 shows that one flange of the leg is in the slot while the other flange is located outside of the slot. The T shaped slot is thus substantially occupied by one half of the H leg.

FIGS. 5 and 6 show that over the major portion of the length of each leg 46, the cross section is generally that of an H shaped beam. Beyond the ends of flange 52, the transverse cross section may be described as T shaped. FIG. 4 shows that only one of the two parallel flanges, at any position of the leg in a respective slot 38, extends outwardly beyond slot 38. The flange edges are illustrated as beveled, although this is not required. Typically, legs 46 are of the same material as that of the rack, but are rigid in any case. It will be apparent that if shorter flange 52 were symmetrically located relative to longer flange 50, then only two different degrees of tilt of the tray would be possible. While not as useful as the leg shown at FIGS. 5 and 6, wherein the shorter flange is asymmetrically positioned relative to the longer flange, the symmetrical location of shorter flange 52 is nonetheless useful in producing two different tilt angles.

While exhibiting utility in the display rack technology, it will be apparent that the novel leg and slot construction of this invention may also be used to vary the height of a table or other horizontal support member. Some peripheral portion of the table is provided with slots 38 and legs 46 shown at FIGS. 5 and 6 placed in each slot. By varying the manner or way of placement of each leg into its respective slot (as with the toothbrush rack), the height of the table may be varied. Such a construction is shown at FIG. 7 where two opposite ends of a table 70 are each provided with the T slot and H leg construction previously described. Alternatively, as shown at FIG. 8, only a single slot and leg may be used to support a table 70 by providing an elongated supporting foot 72 having an H shaped socket 74 receiving the bottom end of the H leg. The length of foot 72 is such as to preclude cantilever tilting of the table.

A typical manner of forming each of the legs 46 of this invention will now be set forth. Injection molding, extruding with post fabrication and/or manual assembly are proposed methods. Note that other methods such as roll forming can be used. Similarly, a typical manner of forming the display rack is as follows: injection molding, stamping, manual assembly, etc. A typical manner of forming the slots 38 is as follows: injection molding, stamping, routing, etc.

We claim:

1. An adjustable height leg construction for a display rack including a display rack having front and rear walls, a pair of opposite side walls, and a bottom wall having a plurality of troughs therein, said rear wall having at least one rearwardly facing, vertically extending T shaped slot, said slot having an abutment at its upper end, said slot being open at its lower end, the upper end of a leg removably and slidably received in said slot, said leg having at least a portion of its length in the shape of an H shaped beam having a central web and two flanges, one of said two flanges being shorter than the other of said flanges, one end of one of said flanges positioned within said slot and in contact with said slot upper end abutment, the other of said flanges located outside of said slot, whereby said leg may be placed in said slot in at least two different ways to yield at least two different degrees of tilt of the rack.

2. The construction of claim 1 wherein said shorter flange is asymmetrically located with respect to the longer flange, such that the distance from one end of the shorter flange to one end of the longer flange is less than the distance from the other end of the shorter flange to the other end of the longer flange, whereby said leg may be placed in said slot in three different ways to yield three different degrees of tilt of the rack.

3. The construction of claim 1 wherein said shorter flange is symmetrically located with respect to the longer flange.

4. The construction of claim 2 wherein said flanges are parallel.

5. The construction of claim 3 wherein said flanges are parallel.

6. An adjustable height leg construction for a table or other horizontal support member, a portion of the table having an open, vertically extending T shaped slot, said slot having an abutment at its upper end, said slot being open at its lower end, the upper end of a leg removably and slidably received in said slot, said leg having at least a portion of its length in the shape of an H shaped beam having a central web and two flanges, one of said two flanges being shorter than the other of said flanges, one end of one of said flanges positioned within said slot and in contact with said slot upper end abutment, the other of said flanges located outside of said slot, whereby said leg may be placed in said slot in at least two ways to yield at least two different heights to the table.

7. The construction of claim 6 wherein said shorter flange is asymmetrically located with respect to the longer flange, such that the distance from one end of the shorter flange to one end of the longer flange is less than the distance from the other end of the shorter flange to the other end of the longer flange, whereby said leg may be placed in said slot in three different ways to yield three different heights to the table.

8. The construction of claim 6 wherein said shorter flange is symmetrically located with respect to the longer flange.

9. The construction of claim 6 wherein said flanges are parallel.

10. The construction of claim 7 wherein said flanges are parallel.

* * * * *